US010022973B2

(12) United States Patent
Tanner et al.

(10) Patent No.: US 10,022,973 B2
(45) Date of Patent: Jul. 17, 2018

(54) REMOTE INK SUPPLY

(75) Inventors: Christopher S. Tanner, San Diego, CA (US); James Pingel, Singapore (SG); David Otis, Corvallis, OR (US)

(73) Assignee: Hewlett Packard Development Company, L.P., Houston, TX (US)

( * ) Notice: Subject to any disclaimer, the term of this patent is extended or adjusted under 35 U.S.C. 154(b) by 667 days.

(21) Appl. No.: 13/255,063

(22) PCT Filed: May 18, 2009

(86) PCT No.: PCT/US2009/044350

§ 371 (c)(1),
(2), (4) Date: Sep. 6, 2011

(87) PCT Pub. No.: WO2010/134905

PCT Pub. Date: Nov. 25, 2010

(65) Prior Publication Data

US 2011/0317204 A1 Dec. 29, 2011

(51) Int. Cl.
*B41J 2/175* (2006.01)

(52) U.S. Cl.
CPC ..... *B41J 2/17509* (2013.01); *B41J 2/175* (2013.01); *B41J 2/17596* (2013.01)

(58) Field of Classification Search
None
See application file for complete search history.

(56) References Cited

U.S. PATENT DOCUMENTS 5,844,580 A 12/1998 Barinaga et al.
5,856,839 A 1/1999 Aukstikalnis et al.
5,860,363 A 1/1999 Childers et al.
6,145,971 A 11/2000 Baker et al.
6,386,693 B1 * 5/2002 Michele et al. ..... 347/86
6,481,837 B1 11/2002 Askren et al.
6,533,404 B1 3/2003 Olsen
6,652,080 B2 11/2003 Childs et al.
2002/0024543 A1 * 2/2002 Kimura et al. ..... 347/7
2003/0058316 A1 3/2003 Olsen
2003/0202057 A1 * 10/2003 Childs et al. ..... 347/85
2004/0125182 A1 * 7/2004 Akermalm ..... 347/85
(Continued)

FOREIGN PATENT DOCUMENTS

CN 1313195 9/2001
EP 0778146 A1 11/1997
(Continued)

OTHER PUBLICATIONS

Supplementary European Search Report. Application No. EP 09 84 5019. dated Feb. 6, 2013.

*Primary Examiner* — Miya J Williams
(74) *Attorney, Agent, or Firm* — HP Inc. Patent Department

(57) ABSTRACT

Apparatus and methods are provided. A supply of ink within a flexible bag is located apart from a printer. A fluid conduit couples the supply of ink to the printer by way of a connecting head. The connecting head includes a pump driven by a mechanical actuator of the printer. Operation of the pump causes a flow of ink from the flexible bag to a printhead of the printer. Pump failure is detected and interpreted as an out-of-ink condition, and user notification and/or cessation of printing operations are automatically performed.

10 Claims, 4 Drawing Sheets

(56) References Cited

U.S. PATENT DOCUMENTS

| | | | | |
|---|---|---|---|---|
| 2004/0257412 | A1* | 12/2004 | Anderson, Jr. ..... B41J 2/17559 | 347/85 |
| 2005/0206698 | A1* | 9/2005 | Aldrich ..... | 347/86 |
| 2006/0071965 | A1* | 4/2006 | Igarashi et al. ..... | 347/19 |
| 2006/0164472 | A1* | 7/2006 | Perez ..... | 347/85 |

FOREIGN PATENT DOCUMENTS

| | | |
|---|---|---|
| EP | 2432642 | 1/2014 |
| JP | 05185603 | 4/1993 |
| JP | 9164698 | 6/1997 |
| JP | 05185603 | 6/2008 |
| KR | 10-1998-0019063 | 6/1998 |
| KR | 10-1998-0070630 | 10/1998 |
| KR | 10-2001-0013253 | 2/2001 |
| WO | WO-9855321 | 12/1998 |

* cited by examiner

REMOTE INK SUPPLY

BACKGROUND

Inkjet printers utilize liquid ink to form images on media. Such printers typically use numerous colors of ink in order to provide color saturation and resolution in accordance with the expectations of the user. Traditionally, such inks are supplied to a printer by way of replaceable cartridges that are supported substantially or entirely within the housing of the printer.

However, users are often dissatisfied with the limited volume of ink that such cartridges provide, resulting in undesirably frequent replacement. The present teachings address the foregoing and other concerns.

BRIEF DESCRIPTION OF THE DRAWINGS

The present embodiments will now be described, by way of example, with reference to the accompanying drawings, in which.

DETAILED DESCRIPTION

Introduction

Means and methods for providing ink from one or more remote sources to a printer are provided by the present teachings. Connecting heads are mechanically engaged to respective ink cartridge receiving ports of the printer. Each connecting head includes a pump that is mechanically powered by an actuator of the printer. Each pump serves to drive the flow of an ink from one of the remote sources through connecting conduits to a printhead of the printer. Check valves prevent the backflow of ink from the printer to corresponding remote sources. Failure of a particular pump is detected by a sensor of the printer and interpreted as an out-of-ink condition. One or more alert messages and/or indications are provided to a user in response to the out-of-ink detection.

In one embodiment, an apparatus includes a connecting head configured to be mechanically coupled to a printer, and fluidically coupled to a remote supply of ink. The connecting head including a pump and a check valve. The pump is configured to cause a flow of the ink by way of reciprocations of a flexible diaphragm. The check valve is configured to prevent the ink from flowing from the pump back to the remote supply of ink. The connecting head is configured to be fluidly coupled to a print head of the printer by way of a fluid conduit.

In another embodiment, a printing system includes a printer including a printhead and an ink cartridge receiving port. The printing system also includes a flexible bag that is configured to contain ink. The flexible bag is remotely located with respect to the printer. The printing system further includes a connecting head configured to be disengagably coupled to the ink cartridge receiving port. The connecting head includes a positive displacement pump driven by an actuator of the printer. The pump is configured to cause ink to flow from the flexible bag to the printhead by way of respective fluid conduits.

In yet another embodiment, a method includes imparting at least one force pulse upon a flexible diaphragm of a pump by way of a printer actuator. The method also includes detecting a failure of the flexible diaphragm to reciprocate in response to the at least one force pulse. The method also includes providing a signal in response to the detecting the failure by way of a printer sensor. The method further includes interpreting the signal as an out-of-ink condition of a remote ink supply coupled to the printer. The interpreting is performed by way of a printer controller. The method also includes issuing a user notification of the out-of-ink condition by way of the printer controller.

First Illustrative Embodiment

Figure 1:
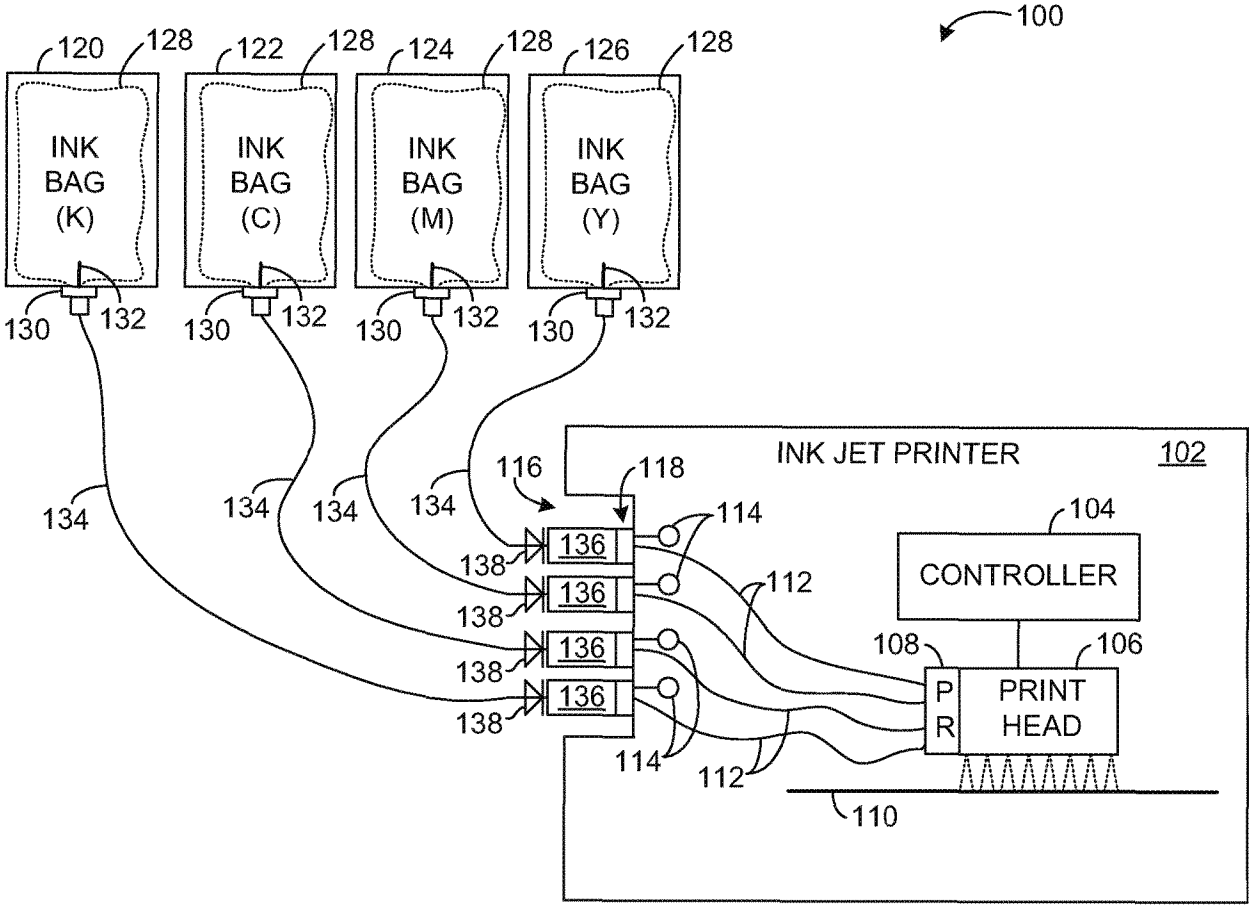
FIG. 1 depicts a schematic diagram of a printing system according to one embodiment.

Reference is now directed to FIG. 1, which depicts a schematic view of a printing system 100. The system 100 is illustrative and non-limiting with respect to the present teachings. Thus, other systems can be configured and/or operated in accordance with the present teachings.

The system 100 includes a printer 102. The printer 102 includes a controller 104 configured to control various normal operations of the printer 102. The controller 104 can be defined by any suitable controller, and can include one or more processors, one or more microcontrollers, application-specific integrated circuitry, state machine logic, analog and/or digital circuits, etc. One having ordinary skill in the printing and related arts can appreciate that the controller 104 can be various defined and configured, and that further elaboration is not required for purposes of understanding the present teachings.

The printer 102 also includes a printhead 106 having a pressure regulator 108. The printhead 106 includes a plurality of ink ejection nozzles configured to apply liquid ink to a media 110 under the control of controller 104. The printhead 106 has one or more pressure regulators 108 which are configured to receive a respective color of liquid ink by way of flexible conduits 112 and to regulate the pressure of that color of ink as it is provided to the respective ink ejection nozzles of the printhead 106.

The printer 102 further includes a plurality of actuators 114 positioned along a receiving bay 116. Each of the actuators 114 is configured to provide force pulses to a respective ink pump under the influence of the controller 104. The actuators 114 can be defined by any suitable mechanical device configured to provide a controllable force pulse. In one embodiment, each actuator 114 is a mechanically-actuated piston. Other embodiments can also be used. Further elaboration regarding the operation of the actuators 114 is provided hereinafter. The receiving bay 116 defines a number of ink cartridge receiving ports 118.

The printing system 100 also includes a plurality of ink supplies 120 through 126, inclusive. Each ink supply 120-126 includes a respective flexible walled ink bag (or sack) 128. In turn, each flexible bag 128 is configured to contain a quantity of liquid ink of a respective color. In one embodiment, each flexible bag 128 is formed from a multi-layer layer material which may include nylon, silver, aluminum, linear low density polyethylene or other materials chosen for strength, compliance and low permeability. See, for non-limiting example, U.S. Pat. No. 6,158,853 or U.S. Patent Application Publication No. 20060017788 A1. Other materials can also be used. As depicted, the system 100 includes four colors of ink (e.g., black, cyan, magenta and yellow). Other systems including other numbers and/or colors of ink are also contemplated by the present teachings. Additionally, each flexible bag 128 is configured to decrease in internal volume as the ink within is drawn away and consumed, resulting in a vacuum backpressure within the respective flexible bag 128.

Each flexible bag 128 further includes a septum 130 that is configured to seal the flexible bag 128 against leaking or other loss of the ink inside. Thus, each septum 130 can also be referred to as a self-sealing septum 130. Each septum 130 can be formed from polyisoprene, EPDM, combinations thereof, or another suitable flexible material. Each septum 130 is further configured to be penetrated (opened) by way of hollow needle 132 inserted there through. Each hollow needle 132 is fluidly coupled to a flexible conduit 134. In this way, the ink within a particular flexible bag 128 can be fluidly coupled to the printer 102 by way of a hollow needle 132 and a flexible conduit 134.

The printing system 100 also includes a plurality of connecting heads 136. Each connecting head 136 includes a check valve 138 and a pump (see FIG. 2), and is configured to be selectively coupled and uncoupled (i.e., mechanically engaged and disengaged) from a respective one of the ink cartridge receiving ports 118. Additionally, each of the connecting heads 136 is coupled to a one of the ink supplies 120-126 by way of a respective flexible conduit 134. The check valves 138 are configured to prevent ink from flowing back into the respective flexible bags 128. Thus, the printing system 100 is configured such that ink flows in one direction only—from the ink supplies 120-126 to the printer 102 by way of the conduits 134 and the connecting heads 136.

Figure 2:
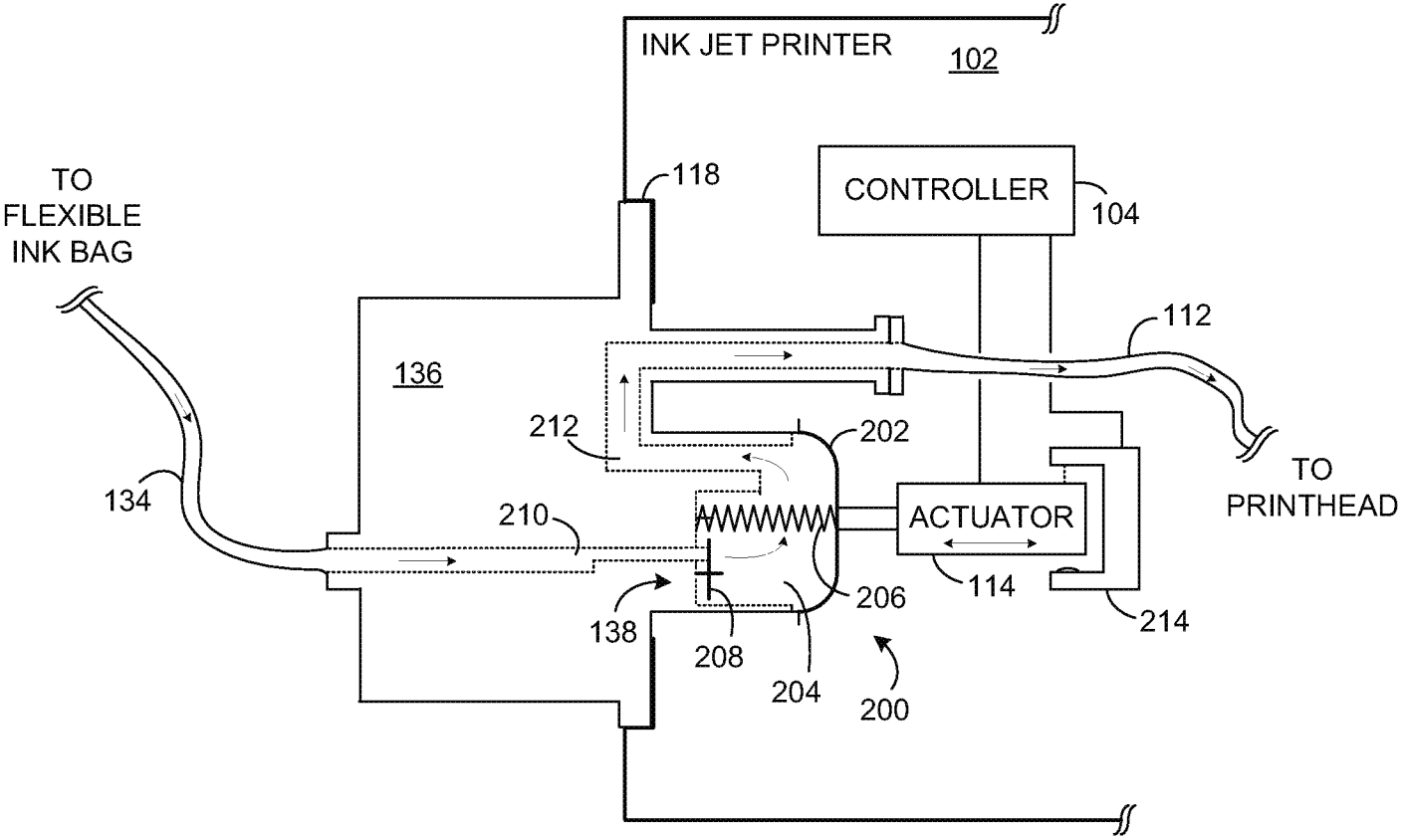
FIG. 2 depicts a schematic diagram of selected details of the printing system of FIG. 1.

Attention is now directed to FIG. 2, which depicts selected details of the printing system 100. As introduced above, the connecting head 136 includes a pump 200. The pump 200 includes a flexible diaphragm 202. The diaphragm 202 is generally dome (or convex) shaped and formed from any suitable flexible material such as EPDM, butyl, EPDM/butyl blends, etc. Other materials can also be used. The flexible diaphragm 202 is disposed adjacent to a pump chamber (or cavity) 204 defined by the material of the connecting head 136. As depicted in FIG. 2, the flexible diaphragm 202 is in a distended state or condition, and is urged into such a distended state by way of a spring 206.

The connecting head 136 also includes the check valve 138, which is defined by a flexible gate or disk 208. The flexible gate 208 can be formed from silicone or another suitable material. The flexible gate 208 is configured to seal off an inlet passageway 210 to the pump chamber 204 when the flexible diaphragm 202 is being acted upon by an outside force (i.e., actuator 114). In this way, the check valve 138 prevents the flow of ink from the pump chamber 204 back through the inlet passageway 210 during normal operations of the pump 200. Thus, the flow of ink within the connecting head 136 is a one-way operation: through the inlet passageway 210 and into the pump chamber 204.

Still referring to FIG. 2, normal operations proceed as follows: the actuator 114 applies a force pulse against the flexible diaphragm 202 under influence of the controller 104. The flexible diaphragm 202 transitions from a distended state to a collapsed state under the force of the actuator 114, thus reducing the internal volume of the pump chamber 204. Ink flows out of the pump chamber 204 through an outlet passageway 212 and into a fluid conduit 112 that couples the ink to a printhead (e.g., 106). The check valve 138 serves to prevent ink from flowing out of the pump chamber 204 by way of the inlet passageway 210.

Once the flexible diaphragm 202 has achieved the collapsed state, the force pulse from actuator 114 is ended (under automatic control). At this point in the operation, the internal volume of the pump chamber 204 is at a minimum, and the flow of ink ceases. Thereafter, the spring 206 operates to urge (i.e., push or bias) the flexible diaphragm 202 back toward the original distended state. As the flexible diaphragm 202 transitions from the collapsed to the distended condition, the internal volume of the pump chamber 204 increases. The increasing volume of the pump chamber 204 serves to draws ink from the fluid conduit 134 through the inlet passageway 210 and the check valve 138, thus refilling the pump chamber 204. Of course, the ultimate source of the ink is the corresponding ink bag 128 as depicted in FIG. 1. The pressure regulator 108 of the printhead 106 may include a check valve mechanism (not shown) that prevents the pump 200 from simply drawing the just-displaced ink back from the printhead. The ink delivery system is typically designed with fluidic impedances that assure that liquid is preferentially drawn from the bag 128 instead of the printhead 106. One pumping cycle is now complete.

The pumping process described above is now repeated continuously or from time-to-time, as required, under automatic control of the controller 104 such that ink is provided to the printhead 106 as needed to sustain normal printing operations. Thus, normal operation of the pump 200 can be described as reciprocations of the flexible diaphragm 202 between the distended condition and the collapsed condition.

These reciprocations, indicative of typical ink-moving operations of the pump 200, are detected by a sensor 214. In one embodiment, the sensor 214 is defined by an optical (light-beam) device that operates by way of a beam of light projected from an emitter across a span toward a detector. Normal operations of the pump 200 are detected as interruptions and restorations of the light beam while the actuator 114 reciprocates with the flexible diaphragm 202. A corresponding signal is provided to the controller 104 as confirmation of normal ink pumping operations.

When the ink within the associated flexible bag 128 is depleted, a vacuum backpressure is communicated to the pump 200. The flexible diaphragm 202 cannot reciprocate and so remains in its collapsed state. As such, the pump 200 fails to operate. When the actuator 114 is actuated, it immediately translates through its full stroke, stopping when it contacts the diaphragm in its collapsed state. This behavior is detected by the sensor 214. As a result, the sensor 214 provides a corresponding signal that is interpreted by the controller 104 as an out-of-ink condition. The controller 104 then halts normal printing operations and provides one or more user notifications that the out-of-ink issue must be addressed by way of, for non-limiting example, indicating lights, e-mail messaging, etc.

It is important to note that FIG. 2 is typical of each color of ink used by the particular printer 102. For purposes of illustration, the printer 102 is understood to consume four colors of ink as described above. Thus, a total of four connecting heads 136—each having a pump 200 and a check valve 138 and being driven by an actuator 114—would be used. Other printing systems having other numbers of connecting heads, pumps, check valves, actuators, sensors, etc., can also be configured and used in accordance with the present teachings.

First Illustrative Method

Figure 3:
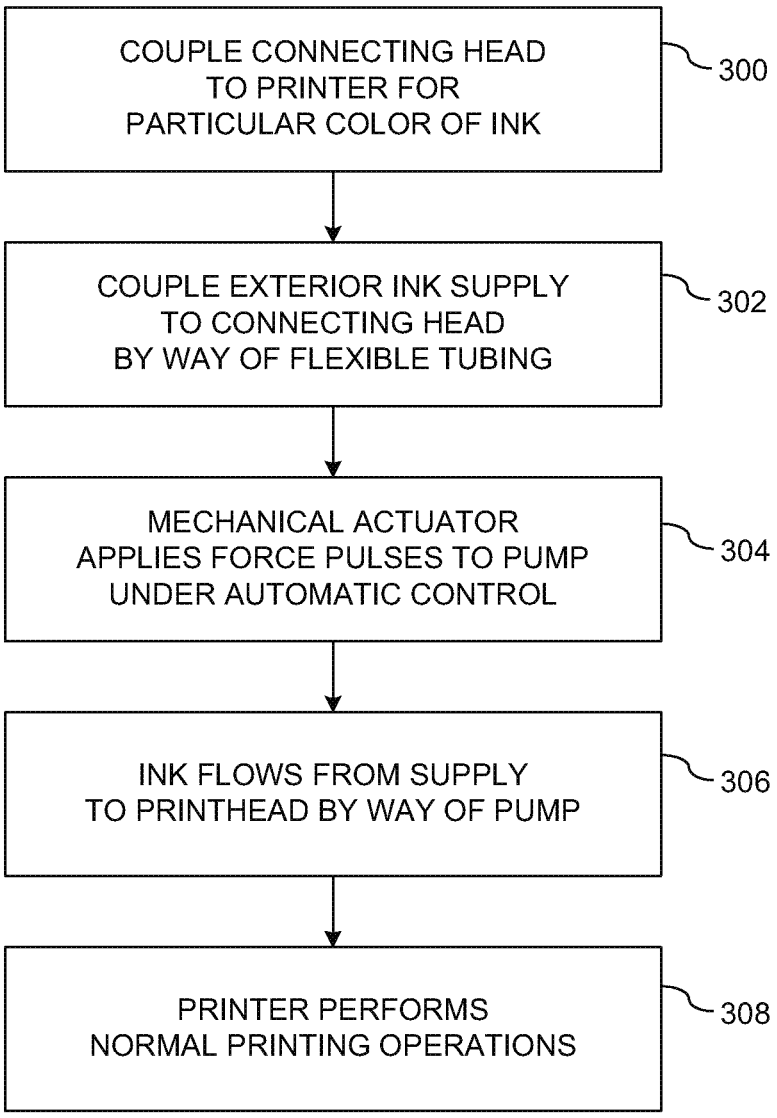
FIG. 3 depicts a flow diagram of a method according to another embodiment.

FIG. 3 is a flow diagram depicting a method according to one embodiment of the invention. The method of FIG. 3 includes particular operations and order of execution. However, other methods including other operations, omitting one or more of the depicted operations, and/or proceeding in other orders of execution can also be used according to the present teachings. Thus, the method of FIG. 3 is illustrative and non-limiting in nature.

At 300, a connecting head is manually coupled to an ink cartridge receiving port of an inkjet printer. The connecting head corresponds to a particular color of ink used by the printer (e.g., black, etc.). For purposes of non-limiting example, it is assumed that a connecting head 136 is coupled to a printer 102 by way of an ink cartridge receiving port 118. In so doing, the connecting head 136 is also mated in fluid communication with a conduit 112 within the printer 102.

At 302, the connecting head is coupled to a supply of ink by way of a flexible liquid conduit (or tubing). The supply of ink is generally located remote from the printer. For purposes of the ongoing example, it is assumed that the connecting head 136 is coupled to a supply 120 having a flexible bag 128 by way of a hollow needle 132 and a fluid conduit 134. Thus, the connecting head 136 is fluidly coupled to a remote supply of ink and is mechanically engaged in fluid communication with the printer 102.

At 304, a mechanical actuator of the printer applies one or more force pulses to a pump of the connecting head under automatic control. Under the ongoing example, it is assumed that an actuator 114 applies a series of force pulses to the flexible diaphragm 202 of the connecting head 136 in accordance with control signals from the controller 104.

At 306, ink flow from the remote supply to the printhead of the printer by way of the pump. For purposes of the ongoing illustration, it is assumed that black ink flows from the flexible bag 128 though the conduit 134, into and out of the pump 200, through the internal conduit 112 and to the pressure regulator 108 of the printhead 106. Such ink flow is maintained until ceased under automatic operation of the controller 104.

At 308, the printer performs normal printing operations on media using the ink supplied from the remote supply (or source). For purposes of the ongoing example, it is assumed that text, images, etc., are formed on sheet media 110 by the printhead 106 using the ink provided by way of the connecting head 136. Such imaging (normal print operations) are performed in accordance with signals provided by the controller 104.

The foregoing method is illustrative of any number of methods contemplated by the present teachings. A remote supply of ink (with respect to a printer) is used for normal printing operations by way of a connecting head and its internal resources. As such, a relatively large quantity of ink can be supplied to a printer so as to proportionately increasing the time between replenishments relative to the use of ink cartridges that are supported (housed) substantially within the printer. Numerous other methods consistent with the operations and/or objectives of the present teachings can also be used.

Second Illustrative Method

Figure 4:
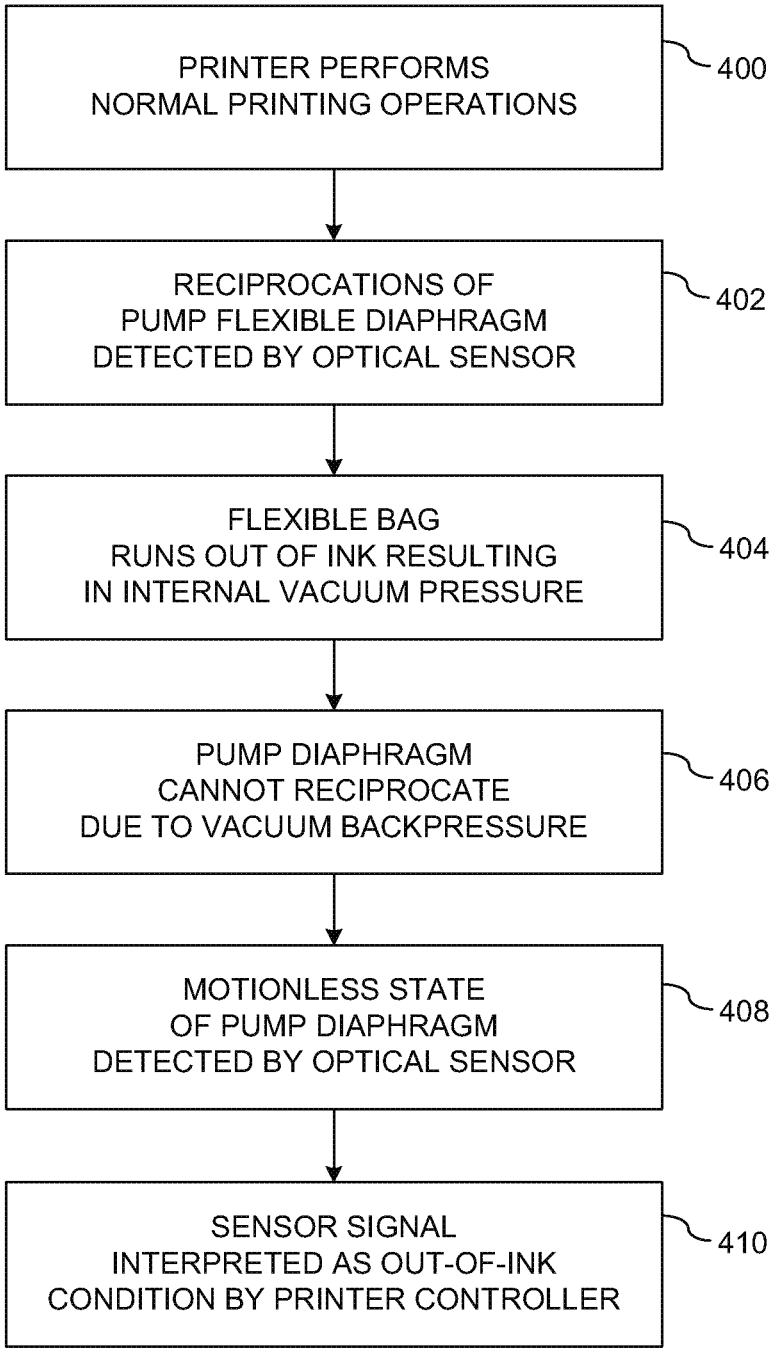
FIG. 4 depicts a flow diagram of a method according to yet another embodiment.

FIG. 4 is a flow diagram depicting a method according to one embodiment of the invention. The method of FIG. 4 includes particular operations and order of execution. However, other methods including other operations, omitting one or more of the depicted operations, and/or proceeding in other orders of execution can also be used according to the present teachings. Thus, the method of FIG. 4 is illustrative and non-limiting in nature.

At 400, a printer performs normal printing operations by application of one or more colors of ink onto sheet media. For purposes of non-limiting illustration, it is assumed that the printer 102 is forming images on sheet media 110 in accordance with controller 104 signaling.

At 402, reciprocations (normal operation) of the flexible diaphragm of an ink pump are detected by an optical sensor. In terms of the ongoing example, it is assumed that the sensor 214 detects normal operations of the flexible diaphragm 202 by way of motion of the actuator 114.

At 404, a flexible bag supplying ink to the printer runs out of ink, resulting in an internal vacuum backpressure communicated to the printer. For purposes of the ongoing example, the flexible bag 128 of the supply 124 is depleted of magenta ink, resulting in a vacuum backpressure being communicated to the corresponding pump 200.

At 406, the flexible diaphragm of the pump coupled to the depleted supply cannot reciprocate due to the vacuum backpressure. For purposes of the ongoing example, the flexible diaphragm 202 of the corresponding pump 200 is in an essentially motionless state, and cannot reciprocate despite force pulses applied by the actuator 114 and/or the urging of the spring 206.

At 408, the motionless state of the pump is detected by the corresponding sensor. For purposes of the ongoing example, it is assumed that the sensor 214 detects the substantially motionless state of the diaphragm 202.

At 410, the sensor signal indicating the motionless condition of the diaphragm is communicated to the controller and is interpreted as an out-of-ink condition. For purposes of the ongoing example, it is assumed that the sensor 214 signal sent to the controller 104 results in a user notification of the out-of-ink condition and/or halting of normal printing operations.

In general, the foregoing description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. An apparatus, comprising:

a connecting head configured to be mechanically coupled to an output ink supply conduit that supplies ink to a printhead in a printer and configured to be coupled to an input ink supply conduit that receives ink from a remote supply of ink, the connecting head including a check valve and a pump comprising a flexible diaphragm, the pump configured to cause a flow of the ink from the remote supply of ink to the printhead via the input ink supply conduit and the output ink supply conduit by way of multiple reciprocations of the flexible diaphragm between distended and collapsed states while the printhead is printing, the check valve configured to prevent the ink from flowing from the pump back to the remote supply of ink, the flexible diaphragm shifting from the distended state to the collapsed state under influence of an actuator that is part of the printer and distinct from the connecting head, the ink forced by transition of the flexible diaphragm from the distended state to the collapsed state directly from the input ink supply conduit to the output ink supply conduit and directly from the output ink supply conduit to the printhead;

a sensor configured to generate signals indicative of the multiple reciprocations of the flexible diaphragm between the distended and collapsed states by sensing movement or lack of movement of the actuator; and controller configured to receive the signals generated by the sensor, detect a failure of the flexible diaphragm to reciprocate based on the received signals, interpret the detection of the failure of the flexible diaphragm to reciprocate as indicative of the remote supply of ink being in an out-of-ink condition, and halt normal printing operation of the printer in response to the interpretation of the failure of the flexible diaphragm to reciprocate as indicative of the remote supply of ink being in an out-of-ink condition.

2. The apparatus according to claim 1, the connecting head further configured to be mechanically coupled to an ink cartridge receiving port of the printer.

3. The apparatus according to claim 1, the remote supply of ink including a flexible bladder, the flexible bladder configured to decrease in volume as the ink is drawn therefrom under the influence of the pump.

4. The apparatus according to claim 1, the pump further configured such that the flexible diaphragm cannot reciprocate when an inlet to the pump is subject to a vacuum backpressure greater than a threshold value.

5. The apparatus according to claim 1, the check valve including a flexible membrane configured to seal an inlet passageway to the pump when the flexible diaphragm is being subjected to an actuator force.

6. A printing system, comprising:

a printer including a printhead and an ink cartridge receiving port;

a flexible bag configured to contain ink, the flexible bag being remotely located with respect to the printer;

a connecting head configured to be disengagably coupled to the ink cartridge receiving port, the connecting head including a positive displacement pump driven by an actuator of the printer, the pump comprising a flexible diaphragm and being configured to cause ink to flow from the flexible bag to the printhead via input and output fluid conduits by way of multiple reciprocations of the flexible diaphragm between distended and collapsed states while the printhead is printing, the flexible diaphragm shifting from the distended state to the collapsed state under influence of an actuator that is part of the printer and distinct from the connecting head, the ink forced by transition of the flexible diaphragm from the distended state to the collapsed state directly from the input fluid conduit to the output fluid conduit and directly from the output fluid conduit to the printhead;

a sensor configured to generate signals indicative of reciprocations of the flexible diaphragm between the distended and collapsed states; and controller configured to receive the signals generated by the sensor, detect a failure of the flexible diaphragm to reciprocate based on the received signals, interpret the detection of the failure of the flexible diaphragm to reciprocate as indicative of the remote supply of ink being in an out-of-ink condition, and halt normal printing operation of the printer in response to the interpretation of the failure of the flexible diaphragm to reciprocate as indicative of the remote supply of ink being in an out-of-ink condition.

7. The printing system according to claim 6, the positive displacement pump further configured such that the flexible diaphragm cannot reciprocate when an inlet to the pump is subject to a vacuum backpressure greater than a threshold value.

8. The printing system according to claim 7, the flexible bag further configured to exhibit the vacuum backpressure greater than the predetermined value when the ink within has been depleted.

9. The printing system according to claim 6, the flexible bag including a self-closing septum, the septum configured to be penetrated by a hollow needle.

10. The printing system according to claim 6, the ink within the flexible bag being fluidly coupled to the positive displacement pump by way of a hollow needle and a flexible fluid conduit.

* * * * *